US005388956A

United States Patent [19]

Pla et al.

[11] Patent Number: 5,388,956

[45] Date of Patent: Feb. 14, 1995

[54] FAN ASSEMBLY AND METHOD FOR REDUCING FAN NOISE

[75] Inventors: Frederic G. Pla, Schenectady; Robert A. Hedeen, Clifton Park, both of N.Y.

[73] Assignee: General Electric Company, Schenectady, N.Y.

[21] Appl. No.: 208,320

[22] Filed: Mar. 9, 1994

[51] Int. Cl.[6] ..... F04D 29/66

[52] U.S. Cl. ..... 415/1; 415/102; 415/119; 416/200 R; 416/203

[58] Field of Search ..... 415/1, 119, 99, 100, 415/101, 102, 103; 416/175, 178, 187, 199, 200 R, 200 A, 203, 500

[56] References Cited

U.S. PATENT DOCUMENTS

| | | | |
|---|---|---|---|
| 3,856,431 | 12/1974 | Tucker | 416/178 |
| 4,746,266 | 5/1988 | Kirchner et al. | 415/119 |
| 4,887,940 | 12/1989 | Todoroki et al. | 416/200 A |
| 5,221,185 | 6/1989 | Pla et al. . | |

FOREIGN PATENT DOCUMENTS

| | | | |
|---|---|---|---|
| 0010412 | 1/1979 | Japan | 415/119 |
| 0222998 | 12/1983 | Japan | 415/119 |
| 0231394 | 9/1993 | Japan | 415/119 |

OTHER PUBLICATIONS

"Active Control of Sound", by P. A. Nelson et al., Institute of Sound and Vibration Research, The University, Southampton,, U.K., Academic Press, 1992, pp. 122–126.

Applicant's attached statement entitled "Microwave Oven Fan Assembly", offered for sale more than one year prior to filing date.

*Primary Examiner*—Edward K. Look
*Assistant Examiner*—Christopher Verdier
*Attorney, Agent, or Firm*—Douglas E. Erickson; Paul R. Webb, II

[57] ABSTRACT

A fan assembly has a fan motor and first and second generally identical and spaced apart fans each rotationally attached to the fan motor to turn at the same rotational speed. Each fan has an equal number of generally identical fan blades and produces noise including a tone having a frequency equal to its rotational speed times its number of fan blades. The fan blades of one fan are angularly offset at a relative phase angle with respect to the fan blades of the second fan such that the tones of each fan generally cancel each other out. An equation is provided for a ducted fan assembly relating the relative phase angle to the rotational speed of the fans, the number of fan blades of each fan, the geometry of the duct, and the speed of sound in air within the duct.

6 Claims, 2 Drawing Sheets

FAN ASSEMBLY AND METHOD FOR REDUCING FAN NOISE

BACKGROUND OF THE INVENTION

The present invention relates generally to reducing fan noise, and more particularly to noise reduction in a fan assembly having two fans driven by a single fan motor.

Fans are used typically for cooling purposes but may be used for other purposes such as, but not limited to, producing thrust in a turbofan jet engine. Cooling fans, such as conventional axial and centrifugal fans, are used on a large number of appliances and electronic and electrical equipment. Noise from these fans is often a problem when the equipment is designed to operate near people, such as in a home or in an office environment. For example, microwave ovens, including conventional designs having a ducted fan assembly with two fans driven by a single fan motor, produce unwanted noise in the kitchen. Fan noise typically has two components: a narrowband component which is due to interactions between the fan's rotating blades and fixed parts, and a broadband component which is due to flow turbulence as the air passes through the fan. The narrowband noise consists of a tone at the blade passage frequency and its harmonics. It is a deterministic signal. The broadband noise is random and is spread over a wide frequency band. Broadband noise tends to be less intrusive to a listener, and conventional techniques for reducing fan broadband noise include adding a resonator, a muffler, or sound deadening material. The narrowband tonal noise is usually more annoying since the listener tends to key on single frequency tones. Conventional techniques for reducing fan narrowband tonal noise include adding a resonator or a muffler, using ducts lined with sound deadening material, and employing active noise control methods. What is needed is a fan design which generally eliminates the annoying narrowband tonal fan noise.

SUMMARY OF THE INVENTION

It is an object of the invention to provide a fan assembly which generally eliminates the narrowband tonal fan noise.

It is another object of the invention to provide a method for generally eliminating the narrowband tonal fan noise in a fan assembly having two fans driven by a single fan motor.

The fan assembly of the invention includes a fan motor, a first fan, and a second fan. The first fan has a number of first fan blades and is rotationally attached to the fan motor to turn at a rotational speed producing noise including a first tone having a frequency equal to the rotational speed times the number of first fan blades. The second fan is generally identical to and spaced apart from the first fan. The second fan has a quantity of second fan blades equal to the number of the first fan blades. The second fan blades are generally identical to the first fan blades. The second fan is rotationally attached to the fan motor to turn at the same rotational speed producing noise including a second tone equal generally to the first tone. The second fan blades are angularly offset at a relative phase angle, with respect to the first fan blades, such that the second tone generally cancels the first tone.

The method of the invention reduces fan noise in a fan assembly having two generally identical and spaced-apart first and second fans rotationally attached to the same fan motor to turn at the same rate wherein the first and second fans have an equal number of generally identical fan blades. The method includes the step of rotating the first fan to turn at a rotational speed producing noise including a first tone having a frequency equal to the rotational speed times the number of fan blades. The method also includes the step of rotating the second fan to turn at the rotational speed producing noise including a second tone equal generally to the first tone. The method further includes the step of angularly offsetting the second fan blades at a relative phase angle with respect to the first fan blades such that the second tone generally cancels the first tone.

Several benefits and advantages are derived from the invention. The unpleasant fan narrowband tonal noise is generally eliminated. Total fan noise is reduced. Noise reduction is achieved by angularly offsetting the second fan blades with respect to the first fan blades, and such angular offset does not add materials or cost or significantly change the design of existing dual-fan/single-motor arrangements.

BRIEF DESCRIPTION OF THE DRAWINGS

The accompanying drawings illustrate a preferred embodiment of the present invention wherein.

DETAILED DESCRIPTION OF THE PREFERRED EMBODIMENT

Figure 1:
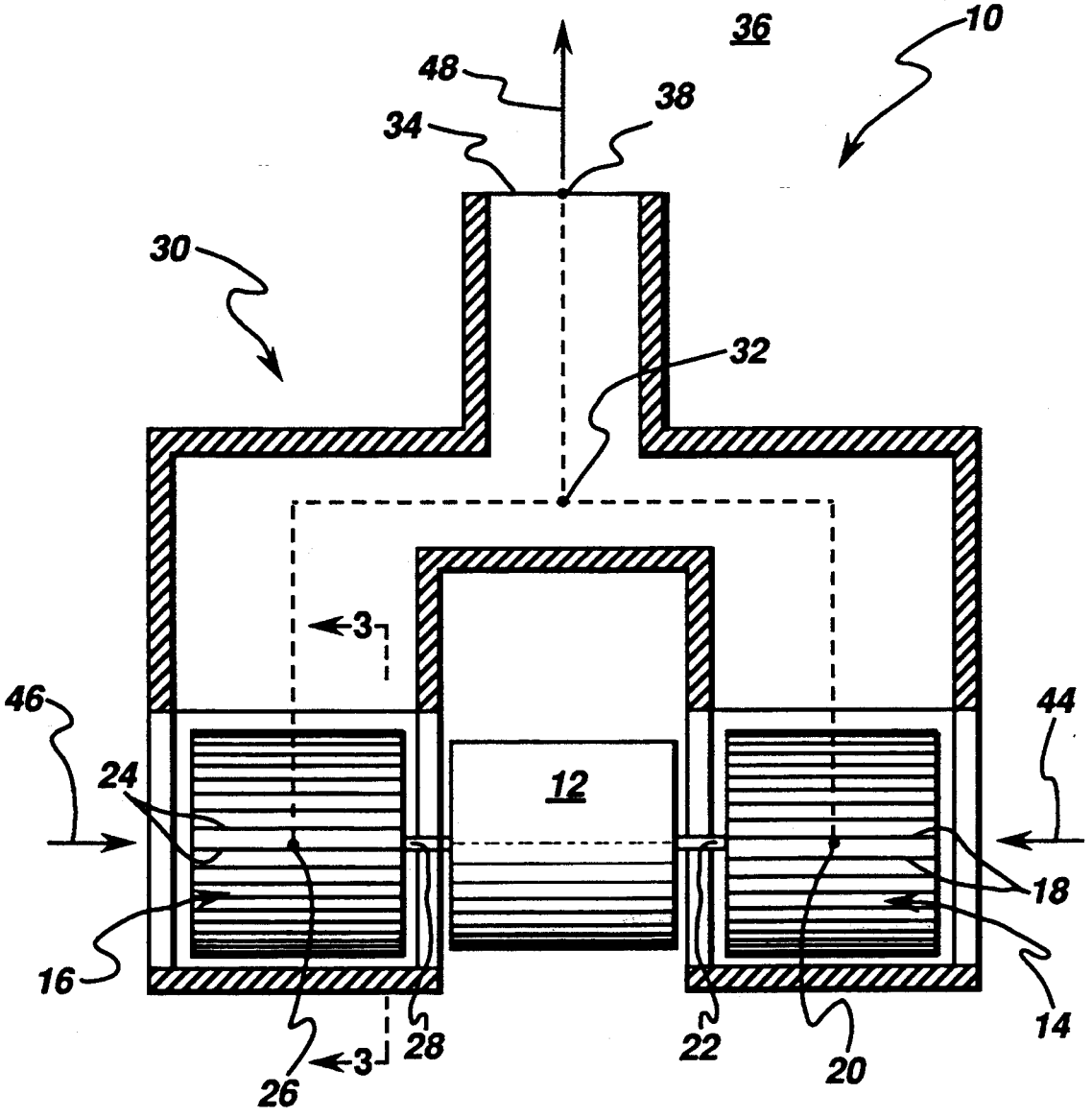
FIG. 1 is a schematic top-planar, cross-sectional view of the fan assembly of the invention.
Figure 2:
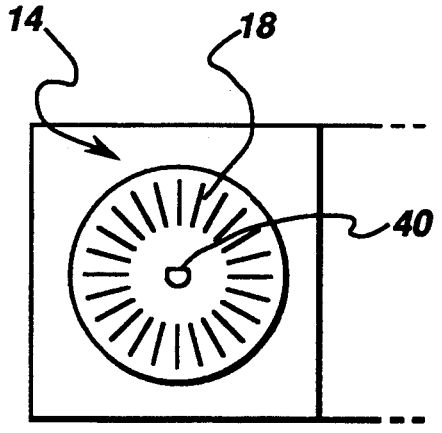
FIG. 2 is a schematic side-elevational view of the first fan of FIG. 1 looking into the first fan when the fan motor is stationary.
Figure 3:
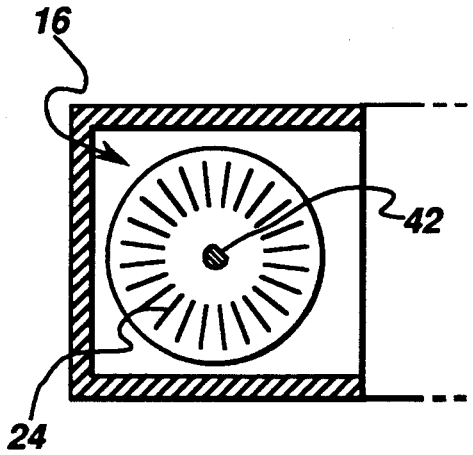
FIG. 3 is a schematic side-elevational, cross-sectional view of the second fan of FIG. 1 taken along line 3—3 looking out of the second fan with the fan motor in the same stationary position as that for FIG. 2.

Referring now to the drawings, wherein like numerals represent like elements throughout, FIGS. 1–3 show the fan assembly 10 of the present invention. The fan assembly 10 includes a fan motor 12, a first fan 14, and a second fan 16. The first fan 14 and the second fan 16 may both be of any type, such as both being axial fans (not shown in the figures) or both being centrifugal fans (as shown in FIG. 1).

The first fan 14 has a number of first fan blades 18 and a first acoustic center 20. The acoustic center of a fan is the center of noise of the fan. If you were to replace the fan's noise from the various parts of the fan with a point source of noise that produced an identical acoustic field, the location of that point would be the acoustic center of the fan. It is analogous to replacing the mass of an object with a point mass and calling that point the center of mass of the object. The acoustic center of a fan can be determined by those skilled in the art and typically is equal generally to the geometric center of the fan. The first fan 14 is rotationally attached to the fan motor 12 to turn at a rotational speed producing noise including a first tone having a wavelength and having a frequency equal to the rotational speed times the number of first fan blades 18. The first fan 14 may be directly attached to a first motor shaft location 22 of the fan motor 12, or it may be indirectly rotationally attached through gears, pulleys, magnetic couplings, etc. As mentioned in the Background of the Invention, a rotating fan will produce noise including narrowband noise consisting of a tone at the blade passage frequency and its harmonics. It is noted here that the blade passage frequency of a fan is the rotational speed times the number of fan blades of the fan.

Figure 4:
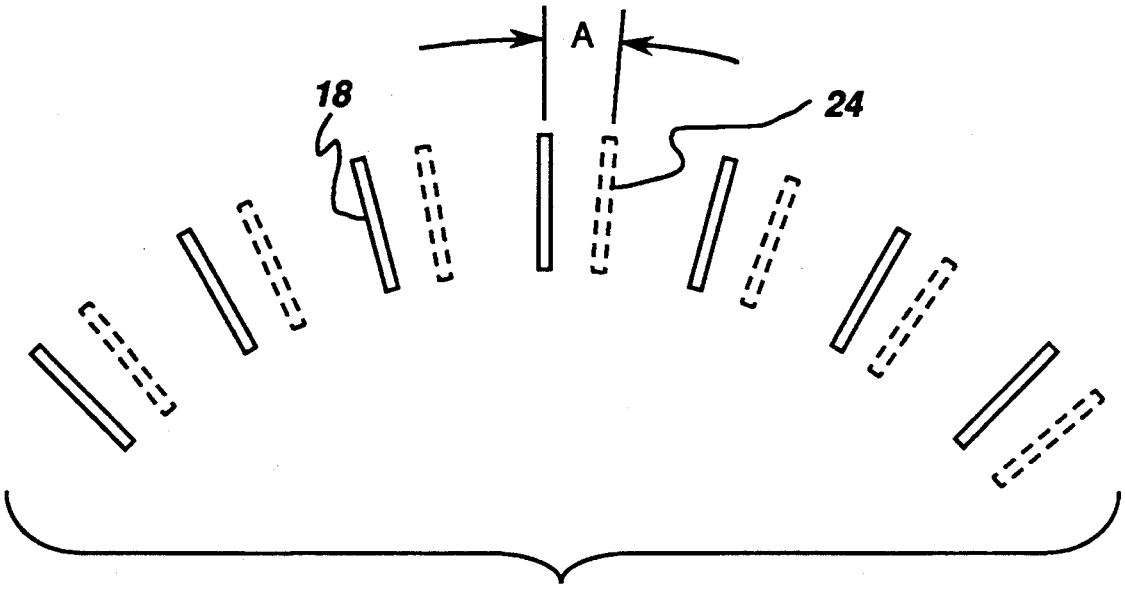
FIG. 4 is an enlarged view of the top portion of FIG. 3 superimposed in phantom line upon the top portion of FIG. 2 showing the relative phase angle of the second fan blades with respect to the first fan blades.

The second fan 16 is generally identical to and spaced apart from the first fan 14. The second fan 16 has a quantity of second fan blades 24 equal to the number of first fan blades 18. The second fan blades 24 are generally identical to the first fan blades 18. The second fan 16 has a second acoustic center 26. The second fan 16 is rotationally attached to the fan motor 12 to turn at a rotational speed, with the rotational speed of the second fan 16 being the same as the rotational speed of the first fan 14 so that the first and second fans 14 and 16 turn at the same rate. Therefore, the second fan 16 will produce noise including a second tone equal generally in both amplitude and frequency to the first tone of the first fan 14. The second fan 16 is attached to a second motor shaft location 28 of the fan motor 12. Preferably, the direction of rotation of the first fan blades 18 and the second fan blades 24 in FIG. 2–4 is clockwise.

The second fan blades 24 are angularly offset at a relative phase angle with respect to the first fan blades 18 such that the second tone generally cancels the first tone. The relative phase angle may be determined experimentally for each fan assembly 10, as is within the purview of one of ordinary skill in the art. Preferably, the second fan 16 is spaced apart from the first fan 14 a distance of less than generally one-eighth of the wavelength of the first tone, such spacing being crucial to cancel the narrowband tonal noise when the fan assembly is an unducted fan assembly.

In an exemplary embodiment, the fan assembly 10 also includes a duct 30 having a centerline duct path from the first acoustic center 20 to the second acoustic center 26. The centerline duct path is shown in FIG. 1 in dashed line as extending from the first acoustic center 20 through point 32 (a reference point, in the centerline duct path, to be described later) to the second acoustic center 26. The duct 30 also has an opening 34 in fluid communication with ambient air 36, a first centerline duct route from the opening 34 to the first acoustic center 20, and a second centerline duct route from the opening 34 to the second acoustic center 26. The first centerline duct route is shown in FIG. 1 in dashed line as extending from the geometric center 38 of the opening 34 through point 32 to the first acoustic center 20. The second centerline duct route is shown in FIG. 1 in dashed line as extending from the geometric center 38 of the opening 34 through point 32 to the second acoustic center 26. The first centerline duct route includes a first portion coinciding with a first segment of the centerline duct path. The coinciding first portion and first segment are shown in FIG. 1 in dashed line as extending from point 32 to the first acoustic center 20. Hence, point 32 is defined as a point which separates the first centerline duct route into its first portion (extending from point 32 to the first acoustic center 20) which is superimposed on the centerline duct path and a portion (extending from point 32 to the geometric center 38 of the opening 34) which is not superimposed on the centerline duct path. Likewise, the second centerline duct route includes a second portion coinciding with a second segment of the centerline duct path. The coinciding second portion and second segment are shown in FIG. 1 in dashed line as extending from point 32 to the second acoustic center 26. It is noted that the centerline duct path is equal to the sum of the first segment and the second segment. When the fan assembly 10 includes the duct 30, the relative phase angle satisfies generally an equation:

$$A=\mathrm{pi}[(2S/c)(L-2X)-1/B],$$

where A is the relative phase angle expressed in radians, S is the rotational speed expressed in revolutions per second, c is the speed of sound in air within said duct, L is the length of the centerline duct path, X is the length of the first segment of the centerline duct path, and B is the number of first fan blades. Applicants derived the above equation from first principles for the relationship of the acoustic pressure at a point between two identical periodic noise sources in a duct. The relative phase angle A given by the above equation is the actual angle that the second fan blades 24 are offset from the first fan blades 18.

As can be appreciated by those skilled in the art, the duct 30 along the centerline duct path should have a small cross-sectional shape relative to the wavelength of the first tone so that the first tone propagates generally as a one-dimensional sound wave. Such calculations are within the skill of the artisan. When the cross-sectional shape is a circle having a diameter, the diameter should always be less than generally one-half of the wavelength of the first tone. When the cross-sectional shape is a rectangle having a length and a width, the length should always be less than generally one-half of the wavelength of the first tone. It is noted that the cross-sectional shape may vary in size and shape along the centerline duct path. However, at any point along the centerline duct path, the characteristic cross-sectional dimension should be small enough with respect to the wavelength of the first tone so that the first tone propagates generally as a one-dimensional sound wave.

The duct 30 may be an exhaust duct whose opening 34 is an outlet (as shown in FIG. 1), or the duct 30 may be an inlet duct (not shown in the figures). Preferably, the first centerline duct route is equal in distance generally to the second centerline duct route. In other words, it is preferred that the first segment of the centerline duct path be equal in length generally to the second segment of the centerline duct path.

Applicants constructed the fan assembly 10 where the duct 30 was an exhaust duct having a cross-sectional shape of generally a rectangle with a length that was about 10 centimeters, and wherein S was 55, L was 25.4 centimeters, X was 12.7 centimeters, B was 26, and A was generally 0.12. Applicants tested such fan assembly and demonstrated that the narrowband tonal noise of the first and second fans 14 and 16 cancelled out.

The method of the invention is a method for reducing fan noise in a fan assembly 10 having a fan motor 12 and generally identical and spaced-apart first and second fans 14 and 16 rotationally attached to the fan motor 12 to turn at the same rate with an equal number of generally identical fan blades (i.e., first fan blades 18 and second fan blades 24). The method includes the step of rotating the first fan 14 to turn at a rotational speed producing noise including a first tone having a wavelength and having a frequency equal to the rotational speed times the number of fan blades. The method also includes the step of rotating the second fan 16 to turn at the same rotational speed as the first fan 14 producing noise including a second tone equal generally to the first tone. The method additionally includes the step of angularly offsetting the fan blades (i.e., second fan blades 24) of the second fan 16 at a relative phase angle with respect to the fan blades (i.e., first fan blades 18) of the first fan 14 such that the second tone generally cancels the first tone.

Preferably, the method also includes the step of disposing the second fan 16 such that the second fan 16 is spaced apart from the first fan 14 a distance of less than generally one-eighth of the wavelength of the first tone. Such step is crucial to cancel the narrowband tonal noise when the fan assembly is an unducted fan assembly.

In an exemplary method, there is also included the step of providing a duct 30 having: a first centerline duct path from the acoustic center (i.e., the first acoustic center 20) of the first fan 14 to the acoustic center (i.e., the second acoustic center 26) of the second fan 16; an opening 34 in fluid communication with ambient air 36; a first centerline duct route from the opening 34 to the acoustic center (i.e., the first acoustic center 20) of the first fan 14; and a second centerline duct route from the opening 34 to the acoustic center (i.e., the second acoustic center 26) of the second fan 16. The provided duct 30 must be one for which the first centerline duct route includes a first portion coinciding with a first segment of the centerline duct path, the second centerline duct route includes a second portion coinciding with a second segment of the centerline duct path, and the centerline duct path is equal to the sum of the first segment and the second segment. In a preferred method, the angularly-offsetting step angularly offsets the fan blades (i.e., second fan blades 24) of the second fan 16 at the relative phase angle with respect to the fan blades (i.e., first fan blades 18) of the first fan 14 such that the relative phase angle satisfies generally an equation:

$$A = \mathrm{pi}[(2S/c)(L-2X)-1/B],$$

where A is the relative phase angle expressed in radians, S is the rotational speed expressed in revolutions per second, c is the speed of sound in air within said duct, L is the length of the centerline duct path, X is the length of the first segment of the centerline duct path, and B is the number of fan blades (i.e., first fan blades 18) of the first fan 14.

Preferably, the duct-providing step includes providing an exhaust duct having an outlet in fluid communication with ambient air 36, as can be seen from the duct 30 and the opening 34 of FIG. 1.

In operation, the relative phase angle A is computed from the equation, and the second fan blades 24 are angularly offset by the relative phase angle A with respect to the first fan blades 18. For precise relative phase setting, a keyed motor shaft and fan hub may be employed, such as the first fiat key 40 for the first fan 14 seen in FIG. 2 and the angularly offset second fiat key 42 for the second fan 16 seen in FIG. 3. As seen from FIG. 1, with the fan motor 12 rotating the first and second fans 14 and 16, ambient air is drawn into the first fan blades 18 as shown by arrow 44 and ambient air is drawn into the second fan blades 24 as shown by arrow 46. The first fan 14 and the second fan 16 each exhaust air in the duct 30 generally towards point 32 and then together exhaust air out of the duct 30 at the opening 34 as shown by arrow 48. The first and second fans 14 and 16 produce noise including broadband noise and narrowband noise. The narrowband tonal noise of the second fan cancels out the narrowband tonal noise of the first fan because of the precise angular offset of the second fan blades 24 with respect to the first fan blades 18.

The foregoing description of a preferred embodiment of the invention has been presented for purposes of illustration. It is not intended to be exhaustive or to limit the invention to the precise form disclosed, and obviously many modifications and variations are possible in light of the above teaching. For example, both fans may be rotationally attached to the motor shaft on the same side of the motor, an inlet duct and an outlet duct may be provided, the angular offset of the second fan blades 24 may lead or lag the first fan blades 18 if the fans are turning in the same direction, the fans may turn in opposite directions, and the fans may each face (i.e., point) in any arbitrary direction. It is intended that the scope of the invention be defined by the claims appended hereto.

We claim:

1. A method for reducing fan noise in a fan assembly having a fan motor and generally identical and spaced-apart first and second fans rotationally attached to said fan motor to turn at the same rate with an equal number of generally identical fan blades, said first and second fans each having an acoustic center, and said method comprising the steps of:

a) rotating said first fan to turn at a rotational speed producing noise including a first tone having a wavelength and having a frequency equal to said rotational speed times said number of fan blades;

b) rotating said second fan to turn at said rotational speed producing noise including a second tone equal generally to said first tone;

c) angularly offsetting said fan blades of said second fan at a relative phase angle with respect to said fan blades of said first fan such that said second tone generally cancels said first tone; and (d) providing a duct having: a centerline duct path from the acoustic center of said first fan to the acoustic center of the second fan; an opening in fluid communication with ambient air; a first centerline duct route from said opening to the acoustic center of said first fan; and a second centerline duct route from said opening to the acoustic center of said second fan, wherein said first centerline duct route includes a first portion coinciding with a first segment of said centerline duct path and said second centerline duct route includes a second portion coinciding with a second segment of said centerline duct path, and wherein said centerline duct path is equal to the sum of said first segment and said second segment, and wherein said angularly-offsetting step angularly offsets said fan blades of said second fan at said relative phase angle with respect to said fan blades of said first fan such that said relative phase angle satisfies generally an equation:

$$A = \mathrm{pi}[(2S/c)(L-2X)-1//B],$$

where A is said relative phase angle expressed in radians, S is said rotational speed expressed in revolutions per second, c is the speed of sound in air within said duct, L is the length of said centerline duct path, X is the length of said first segment of said centerline duct path, and B is said number of fan blades of said first fan.

2. The method of claim 1, wherein said duct-providing step includes providing an exhaust duct.

3. A fan assembly comprising:

a) a fan motor;

b) a first fan having a number of first fan blades and a first acoustic center, said first fan rotationally attached to said fan motor to turn at a rotational speed producing noise including a first tone having a wavelength and having a frequency equal to said rotational speed times said number of first fan blades;

c) a second fan generally identical to and spaced apart from said first fan, said second fan having a quantity of second fan blades equal to said member of first fan blades and a second acoustic center, said second fan blades generally identical to said first fan blades, said second fan rotationally attached to said fan motor to turn at said rotational speed producing noise including a second tone equal generally to said first tone, and said second fan blades angularly offset at a relative phase angle with respect to said first fan blades such that said second tone generally cancels said first tone; and (d) a duct having: a centerline duct path from said first acoustic center to said second acoustic center; an opening in fluid communication with ambient air; a first centerline duct route from said opening to said first acoustic center; and a second centerline duct route from said opening to said second acoustic center, wherein said first centerline duct route includes a first portion coinciding with a first segment of said centerline duct path and said second centerline duct route includes a second portion coinciding with a second segment of said centerline duct path, wherein said centerline duct path is equal to the sum of said first segment and said second segment, and wherein said relative phase angle satisfies generally an equation:

$$A = \mathrm{pi}[(2S/c)(L-2X)-1/B],$$

where A is said relative phase angle expressed in radians, S is said rotational speed expressed in revolutions per second, c is the speed of sound in air within said duct, L is the length of said centerline duct path, X is the length of said first segment of said centerline duct path, and B is said number of first fan blades.

4. The fan assembly of claim 3, wherein said duct is an exhaust duct, said opening is an outlet, and said first segment of said centerline duct path is equal in length generally to said second segment of said centerline duct path.

5. The fan assembly of claim 4, wherein said first fan is a centrifugal fan and said second fan is a centrifugal fan.

6. The fan assembly of claim 5, wherein S is 55, L is 25.4 centimeters, X is 12.7 centimeters, B is 26, and A is generally 0.12.

* * * * *